US009873544B1

(12) United States Patent
Muhammad

(10) Patent No.: US 9,873,544 B1
(45) Date of Patent: Jan. 23, 2018

(54) BEVERAGE CARTON DIVIDER

(71) Applicant: Fully Focused, Inc., Chicago, IL (US)

(72) Inventor: Amanee Muhammad, Chicago, IL (US)

(73) Assignee: Fully Focused Inc., Chicago, IL (US)

( * ) Notice: Subject to any disclaimer, the term of this patent is extended or adjusted under 35 U.S.C. 154(b) by 0 days.

(21) Appl. No.: 15/277,691

(22) Filed: Sep. 27, 2016

Related U.S. Application Data

(60) Provisional application No. 62/359,738, filed on Jul. 8, 2016.

(51) Int. Cl.

| | |
|---|---|
| ***B65D 25/04*** | (2006.01) |
| ***B65D 5/48*** | (2006.01) |
| ***B65D 5/02*** | (2006.01) |
| ***B65D 5/06*** | (2006.01) |
| ***B65D 5/40*** | (2006.01) |
| ***B65D 5/42*** | (2006.01) |
| ***B65D 5/74*** | (2006.01) |

(52) U.S. Cl.
CPC ..... *B65D 5/48014* (2013.01); *B65D 5/0227* (2013.01); *B65D 5/067* (2013.01); *B65D 5/40* (2013.01); *B65D 5/4266* (2013.01); *B65D 5/746* (2013.01)

(58) Field of Classification Search
CPC .... B65D 5/48014; B65D 5/0227; B65D 5/40; B65D 5/4266; B65D 5/746; B65D 5/067; B65D 71/50; B65D 77/065
USPC ..... 229/120.03, 120.02, 120.04, 120.05, 229/120.06, 120.08, 120.11, 120.13, 229/120.37, 120.38, 121, 213, 214, 215, 229/216, 217, 218, 219
See application file for complete search history.

(56) References Cited

U.S. PATENT DOCUMENTS

| | | | | |
|---|---|---|---|---|
| 2,514,858 | A * | 7/1950 | Gray | B65D 71/44 206/431 |
| 2,801,129 | A * | 7/1957 | Gegan | B65D 71/50 206/431 |
| 2,846,063 | A * | 8/1958 | Fahrenbach | B65D 71/50 206/431 |
| 3,080,965 | A * | 3/1963 | Kuchenbecker | B65D 71/02 206/431 |
| 5,715,992 | A * | 2/1998 | Andrews, Sr. | B65D 5/46104 229/104 |
| 5,772,109 | A * | 6/1998 | Phipps | B65D 71/50 229/117.23 |
| 6,182,887 | B1 * | 2/2001 | Ljunstrom | B65D 5/067 206/806 |
| 9,751,656 | B2 * | 9/2017 | Wolf | B65D 5/746 |
| 2014/0262900 | A1 * | 9/2014 | Shalkop | B65D 5/727 206/459.1 |

* cited by examiner

*Primary Examiner* — Christopher Demeree
(74) *Attorney, Agent, or Firm* — Dunlap Bennett & Ludwig PLLC; Brendan E. Squire

(57) ABSTRACT

A beverage container to enable the manufacture and packaging of two flavors of juice or other liquid drinks. At present, the preference and favorite flavor of an individual consumer is not accommodated unless two or more products are purchased. This invention provides a cardboard or plastic divider panel that is incorporated into any existing cartons that overcomes these limitations by enabling a carton to be divided into two flavors. Each side of the beverage container has a spout for separate pouring the contents of that particular side.

13 Claims, 14 Drawing Sheets

BEVERAGE CARTON DIVIDER

CROSS-REFERENCE TO RELATED APPLICATION

This application claims the benefit of priority of U.S. provisional application No. 62/359,738, filed Jul. 8, 2016, the contents of which are herein incorporated by reference.

BACKGROUND OF THE INVENTION

The idea for the juice carton divider arose from observed needs in customer preference and in the marketplace for fruit, flavored and other liquid beverages. Within many families there is distinct preference among the members as to their desired flavors of liquid drinks. Invariably one or more member will have to forgo their preference, or either the purchaser will have to buy more than one flavor. Packaging two flavors within one container will avoid this dilemma, giving the customer more choices and more value by not purchasing more than is needed and by satisfying every family preference.

This application relates to an improved juice package for use in this process. Popular forms of conventional packing container are the 64 oz. and 59 oz. rectangular paperboard carton and our invention is an innovation over this existing prior art that enables two separate flavors of liquid to be packaged in the same container. Conventional packaging lines are flavor specific and because retail stores demand such variety of flavors and packages for those flavors, a large inventory must be kept on hand. The consumer too is limited by current juice and flavored drink manufacturing and packaging techniques.

From the foregoing, it is clear that a need exists in the art for an improved container. This invention relates to cartons and, more particularly, juice and other liquid drink cartons. Accordingly, as an object of the present invention to provide an addition to existing carton designs whereby this addition to present carton designs provides a technique for subdividing a container into a plurality of separate compartments so that the contents of one container can be divided and separated into two flavors with neither flavor touching the other.

SUMMARY OF INVENTION

It is an object of this invention to provide a modification to existing containers for juice products that can be readily supplied to an individual consumer in two of their favorite flavor within one container. It is another object of this invention to provide a simplified manufacturing method and apparatus for packaging the liquid drink products.

One aspect of the invention includes a carton for separately containing and independently dispensing two liquids. The carton includes a substantially rectangular tubular carton having at least one sidewall and a bottom wall defining a cavity therein. There is an opening at a top end of the carton, with a plurality of folds formed in the at least one sidewall configured, when folded, to produce a gabled closure at the opening; the gabled closure having a pair of inwardly inclined surface walls joined along a sealed ridge. A divider panel has a plurality of flanges, wherein the flanges are sealingly attached to an interior surface of the at least one sidewall, the bottom wall, and the gabled closure. The divider panel separates the cavity into a first cavity and a second cavity. A first spout is formed in a first inwardly inclined surface wall and a second spout is formed in an opposite inwardly inclined surface wall, wherein the first spout is in fluid communication with the first cavity and the second spout is in fluid communication with the second cavity.

In some embodiments, the divider panel extends between a first interior corner of the cavity and an opposite interior corner of the cavity. The divider panel may also extend between a first interior sidewall surface and a second interior sidewall surface. The first interior sidewall surface may be opposite the second interior sidewall surface, while in other embodiments, the first interior sidewall surface is adjacent to the second interior sidewall surface.

In some aspects of the invention, the divider panel has a substantially rectangular lower end portion and a substantially triangular upper end portion. A first flange may be formed along a left and a right vertical edge of the lower end portion. A second flange may be formed along a bottom edge of the lower end portion and a third flange may be formed along a first and a second inwardly inclined edge of the upper end portion. In certain embodiments, the first flanges extend from an opposite face of the divider panel. The third flanges may also extend from an opposite face of the divider panel. The flanges of the divider panel are sealingly attached to the interior sidewalls with an adhesive.

Other aspects of the invention include a tubular carton having at least one sidewall and a bottom closure defining a cavity therein, an opening at a top end of the carton, and a gabled closure at the top end to seal the opening. The gabled closure has a pair of inwardly inclined surface walls joined along a sealed ridge. The carton also includes a divider panel sealingly separating the cavity into a first cavity and a second cavity. A first spout extends through the at least one sidewall and is in fluid communication with the first cavity and a second spout extends through the at least one sidewall is in fluid communication with the second cavity.

The divider panel has a plurality of flanges defined along a peripheral edge thereof, wherein the flanges are sealingly attached to an interior surface of the at least one sidewall, the bottom wall, and the gabled closure. A plurality of folds may be formed in an upper portion of the at least one sidewall and is configured, when folded, to produce a gabled closure at the opening. The gabled closure has a pair of inwardly inclined surface walls joined along a sealed ridge. A first spout opening is formed in a first inwardly inclined surface wall and a second spout opening is formed in an opposite inwardly inclined surface wall, wherein the first spout opening is in fluid communication with the first cavity and the second spout opening is in fluid communication with the second cavity.

Yet other aspects of the invention include a material configured to form a folded beverage container. The material is formed of a substantially rectangular sheet of foldable material having a plurality of vertical fold lines extending between a top edge of the sheet and a bottom edge of the sheet, the fold lines define a plurality of sidewall panels. A lower horizontal fold line extending across a width of the sheet defining a lower closure portion. A pair of lower diagonal fold lines originate at an intersection of the plurality of vertical fold lines and the lower horizontal fold line and terminate at an intersection point that is midway between the plurality of vertical fold lines and proximal to a lower edge of the sheet. A first upper horizontal fold line extends across a width of the sheet and defines a gabled closure portion. A second upper horizontal fold line extends across an edge portion of the sheet defining a gabled closure sealing portion. The gabled closure portion has a plurality of upper diagonal fold lines originating at an intersection of the plurality of vertical fold lines and the upper horizontal fold line and terminate at an apex along the second upper horizontal fold line. A plurality of vertical divider panel folds are formed in one of the plurality of sidewall panels defining a divider panel. A plurality of divider flange fold lines are also formed in the divider panel defining a top flange, a bottom flange, and a vertical edge flange that are configured for sealing engagement with the interior sidewalls of the carton when the sheet is folded.

The present invention provides a divider panel composed of the same material as the carton itself, which satisfies each of the aforementioned needs. The present invention contemplates a divider panel which fits within the interior of the existing refrigerated carton consisting of polyethylene layered paperboard or other material and an addition to the existing prior art container that folds into and forms a similar divided panel within the carton that accommodates two separate compartments.

DESCRIPTION OF THE SEVERAL VIEWS OF THE DRAWING

The invention will best be understood with reference to the drawings when taken in connection with the accompanying descriptive portion of the specification following hereinafter. In the drawings the components in the figures are not necessarily to scale, emphasis instead being placed upon illustrating the principles of the design. Moreover, in the figures, like referenced numerals designate corresponding parts throughout the different views. The specific examples of the invention as herein shown and described are for illustrative purposes.

The cartons being illustrated are a substantially rectangular cubic shaped but it is apparent that any other suitable cross-section, for example square, could be used. Various other changes in structure will no doubt occur to those skilled in the art, and will be understood as forming a part of the present invention insofar as they fall within the spirit and scope of the appended claims.

DETAILED DESCRIPTION OF THE ILLUSTRATIVE EMBODIMENTS

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved beverage carton for separately containing and independently delivering two dissimilar beverages.

Figure 1:
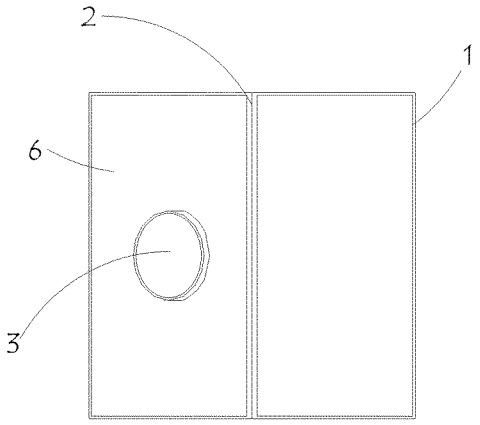
FIG. 1 is a top plan view of the assembled rectangular, single panel formed tubular carton and, and showing carton spout when the gabled top 2 is closed and sealed after manufacture.

Referring to FIG. 1, there will be seen a top view of the prior art for a carton (hereinafter "carton"), a rectangular, single panel formed tubular carton 1, and showing a first spout 3 when the gabled top 2 is closed and sealed after manufacture. The container 1 is of rectangular square configuration as its base, then rising to a point at which the rectangular sides are folded inward and adhered to form a gabled top 2, on which is located a spout 3 for pouring of the liquid contained within the carton.

Figure 2:
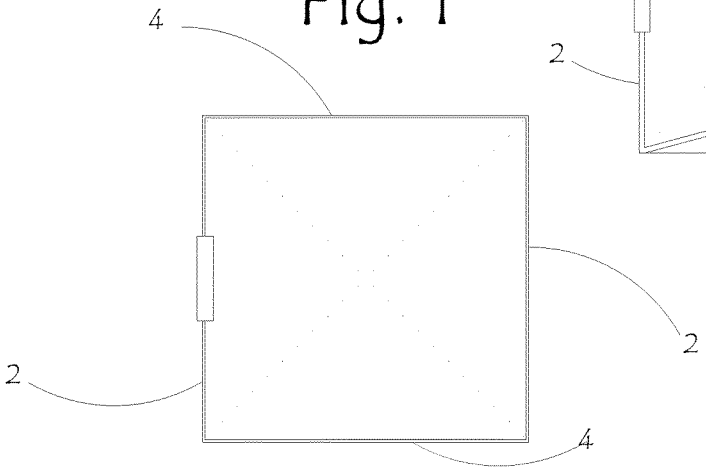
FIG. 2 is a top view of the assembled rectangular, single panel formed tubular carton and, when the gabled top 2 of the carton is opened and unassembled.

Referring to FIG. 2, there will be seen a side view of the prior art for a carton, a rectangular, single panel formed tubular carton 1, and showing sides of the carton open when the gabled top 2 of the carton is opened and unassembled and unsealed. The top of two sides 4 are folded inward and the top of other two sides 2 are joined and adhered.

Figure 3:
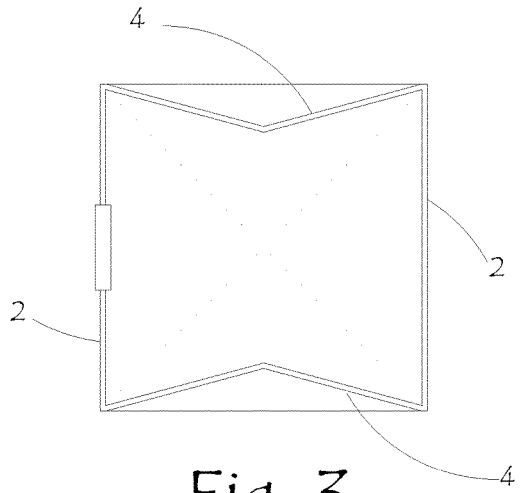
FIG. 3 is a top view of the assembled rectangular, single panel formed tubular carton and when the gabled top 2 of the carton is partially collapsed toward its seal position as in FIG. 1.

Referring to FIG. 3, there will be seen a top view of the assembled rectangular, single panel formed tubular carton, when the gabled top 2 of the carton is partially collapsed toward its seal position as in FIG. 1. The opposed gable edges 2 are inclined inward as the other opposed sides 4 are folded inwardly along a plurality of fold lines. The opposed gable edges 2 are joined and adhered.

Figure 4:
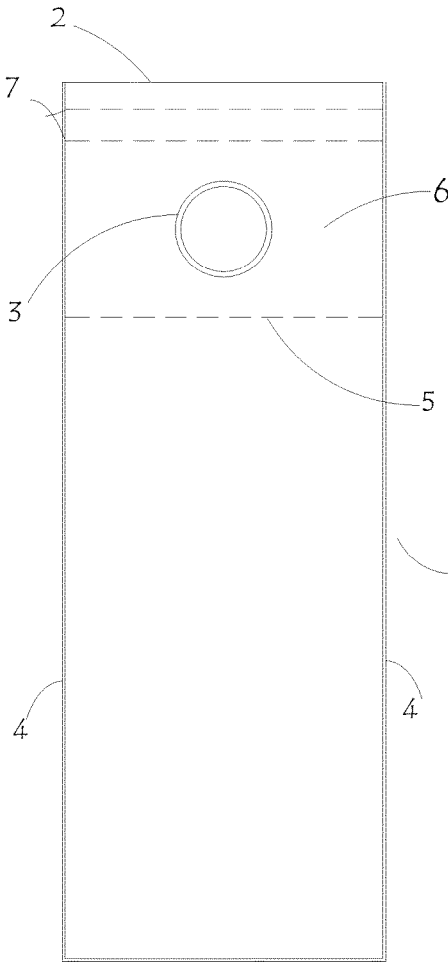
FIG. 4 is a spout side panel 6 view of the assembled rectangular, single panel formed tubular carton and, when the gabled top 2 of the carton is opened and unassembled.

Referring to FIG. 4, there will be seen a spout side view of the assembled rectangular, single panel formed tubular carton 1 with the gabled top 2 of the carton 1 opened and unassembled. A flat surface of a spout side panel 6 of the carton 1 being configured with a spout 3 at an upper portion thereof for pouring. A crease line 5 at which the spout side panel 6 of gable top 2 is folded inwardly to meet and adhere to an opposite side of the carton 1 is formed on the spout side panel 6 and the opposite side panel. One or more second horizontal crease lines 7 along which gable top ends 2 are folded and adhered for a closure portion of the carton top are defined near a top end on these same panels.

Figure 5:
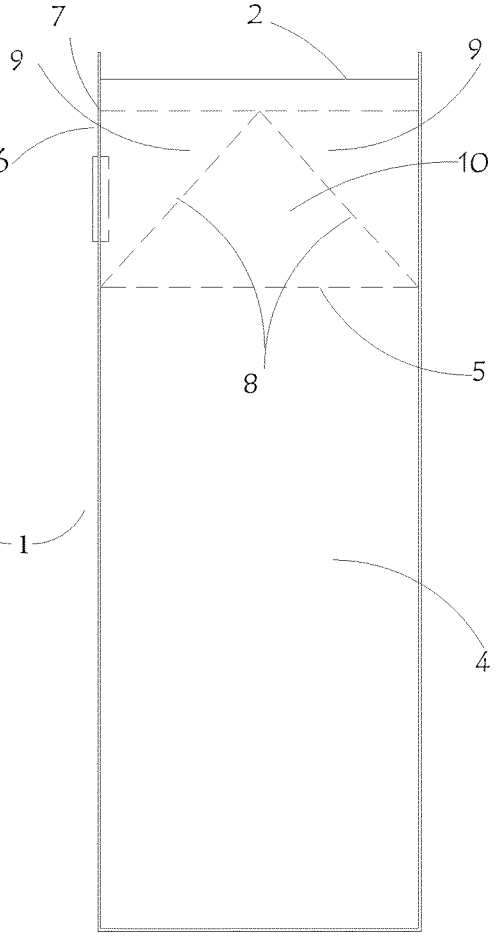
FIG. 5 is a side end view of the assembled rectangular, single panel formed tubular carton and, when the gabled top 2 of the carton is opened and unassembled.

Referring to FIG. 5, there will be seen a side view of the assembled rectangular, single panel formed tubular carton 1 when the gabled top 2 of the carton 1 is opened and unassembled. Adjacent side surfaces 4 of the carton 1, (those adjacent to the spout side panel 6), are also formed with a first horizontal crease 5 at which the adjacent sides 4 are folded inwardly to form an indented portion of the gable top 2. A pair of diagonal crease lines 8 extend from the ends of first horizontal crease 5 to a midpoint of the second horizontal crease line 7, such that, when folded inwardly, fold panels 9 are formed and collapse flat and parallel to either side of spout panel 6 and its opposite side. A triangular face 10 is formed at the indentation with the closure of adjacent side surfaces 4 along crease lines 5 and 8.

Figure 6:
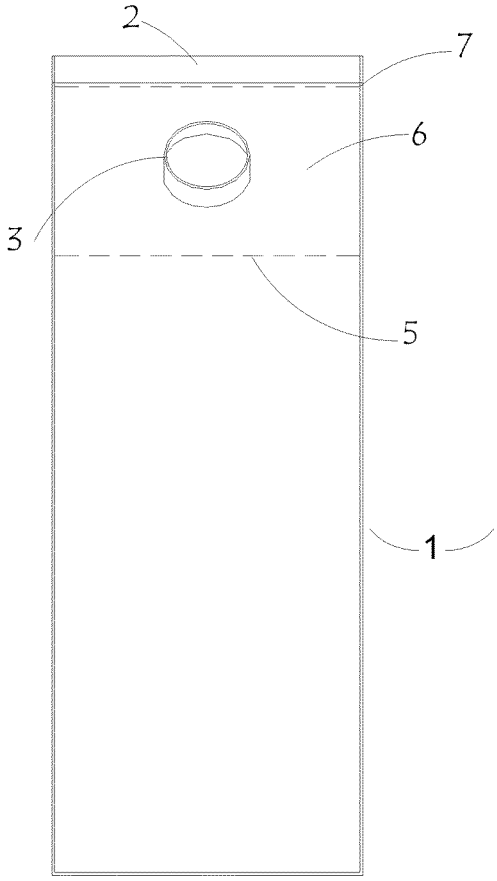
FIG. 6 is a spout side panel 6 view of the assembled rectangular, single panel formed tubular carton and, when the gabled top 2 is closed and sealed after manufacture.

Referring to FIG. 6, there will be seen a side view of the assembled rectangular, single panel formed tubular carton 1 with the gabled top 2 closed and sealed after manufacture. The spout side panel 6 of the carton 1 carries the spout 3 for pouring. Crease line 5, indicates the crease at which the spout side panel 6 and opposite panel are folded to form the gable top 2. The ends of the spout side panel 6 and opposite side panel are folded along the second crease line 7 and adhere to form the top closure of the carton 1.

Figure 7:
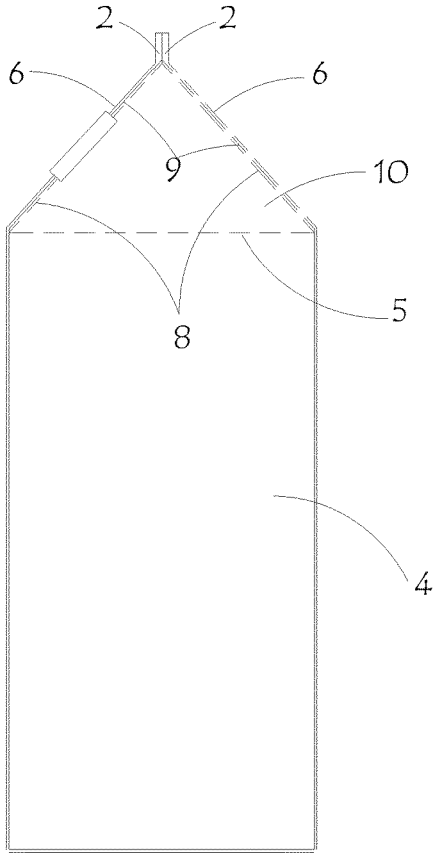
FIG. 7 is a side view of the assembled rectangular, single panel formed tubular carton and, when the gabled top 2 is closed and sealed after manufacture.

Referring to FIG. 7, there will be seen a side view of the assembled rectangular, single panel formed tubular carton 1 with the gabled top 2 closed and sealed after manufacture. The adjacent side panel 4 shows the triangular face 10 extending diagonally inwardly along diagonal crease lines 8 and the fold panels 9 substantially parallel to the spout side panel 6 and opposite side panel 6.

Figure 8:
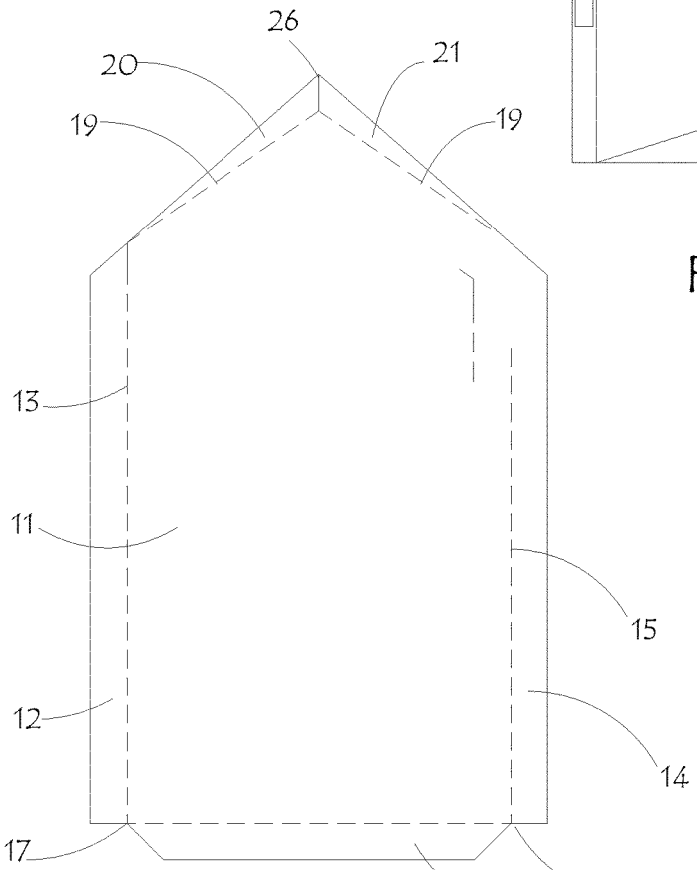
FIG. 8 is a front, 2 dimensional view of a divider panel of the present invention before its incorporation and manufacture into a juice or liquid drink carton.

Referring to FIG. 8, there will be seen a 2 dimensional view of an embodiment of a diagonal divider panel 11 of the present invention before its incorporation and manufacture into a juice or liquid drink carton 1, before any folds or adherence to an inner sidewall of the carton 1. The panel 11 is substantially rectangular, with a triangular top end portion.

A side flange 12 and 14 are defined along a left and a right edges of the divider 11 and are formed by folding along a vertical crease line 13 and 15 at 45-degree angle. An outer corner edge formed by the folds at 13 and 15 are adhered to opposite interior corners of the carton and the opposite side of flange 12 and 14, then be adhered to the interior surface of the carton. The flange 14 on the right of the divider may be folded in the opposite direction as that of flange 12 and will then adhered to the interior surface of the container exactly opposite diagonal the first. A bottom flange 16 is formed at the bottom of the divider 11 along crease line extending from the corners 17 to 18. Bottom flange 16 is then adhered to the bottom of the carton 1.

Flanges 20 and 21 at the top of the divider 11 are created by folding along crease lines 19 on both sides. Crease lines 19 begin at the intersection of left and right crease lines 13 and 15 and extend along a diagonal that is less than that of the side edges of the flanges 20 and 21 to intersect at a point below the apex of the triangular top end portion. A cut 26 is formed between the apex and the intersection of crease lines 19. Flanges 20 and 21 are adhered to an interior surfaces of the gable sides 6 of the carton 1.

Figure 9:
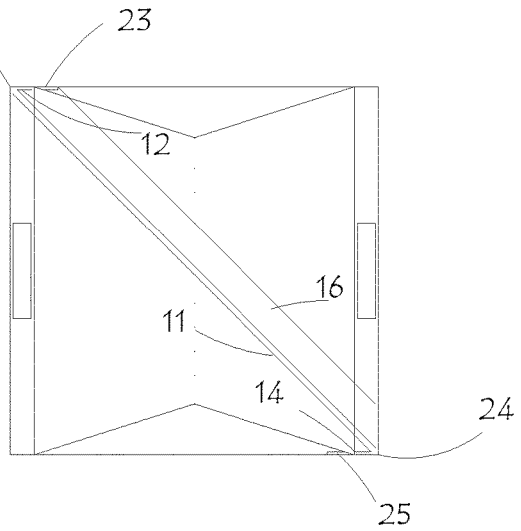
FIG. 9 is a top view of the present invention when incorporated into an assembled rectangular, single panel formed tubular carton, showing the attachment of bottom and side flanges and the new additional spout accommodated by the invention.

Referring to FIG. 9, there will be seen a top view of a divider 11 of the present invention when incorporated into an assembled rectangular, single panel formed tubular carton 1, showing the attachment of bottom 16 and side flanges 12 and 14. A second, additional spout opening is formed on the opposite panel. As illustrated, the outer corner of flange, 12, is adhered to a first corner 22 of the carton 1 and the opposite side of flange 12 is adhered to the interior surface of the carton 23. Similarly, on the right of the divider 11, the outer corner of flange 14 is adhered to a diagonally opposite corner of the carton 24 and the opposite side of flange 14 is adhered to the interior surface of the carton 25. The bottom flange 16 is adhered to the bottom of the carton 26. For clarity of illustration, flanges 20 and 21 at top are not shown on this drawing.

Figure 10:
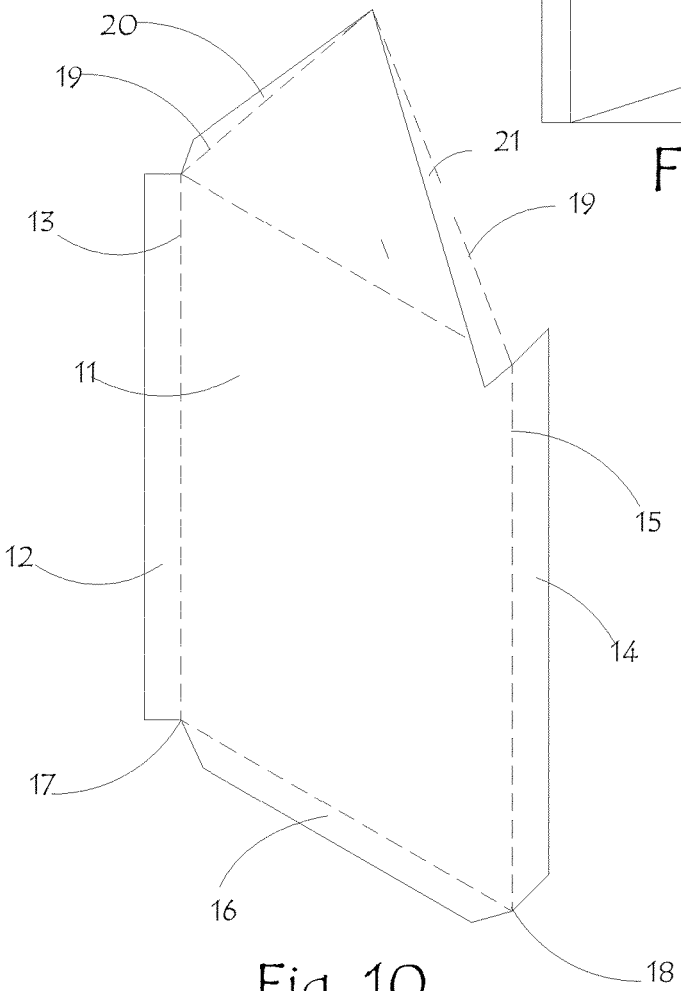
FIG. 10 shows a perspective view of a divider panel of the present invention before its incorporation and manufacture into a juice or liquid drink carton, and showing the creases and direction of the folds that fit into and adhere to the existing cartons.

Referring to FIG. 10, there shown a perspective view of an alternative embodiment of the divider panel 11 of the present invention before its incorporation and manufacture into a juice or liquid drink carton 1 and showing the creases and direction of the folds that fit into and adhere to the existing cartons. The divider panel 11 shows the vertical invention before any folds or adherence to cartons. The flange 12 on the left edge of the divider 11 will be created by folding at the vertical crease line 13 at 45-degree angle, and the outer corner formed by the folding at 13 is adhered to the corner of the carton 1 and the opposite side of flange 12 is then be adhered to the interior surface of the carton 1. Similarly, the flange 14 on the right of the divider is similarly formed by folding at crease line 15 in the opposite direction and will also be adhered to the interior surface of the container 1 exactly opposite diagonal the first. The bottom flange 16 is formed by folding along the crease line extending from the corners 17 and 18 and adhered to the bottom of the carton 1. Flanges 20 and 21 at top of divider are created by folding along lines 19 on both sides and when installed in carton, are adhered to interior of gable sides of the carton.

Figure 11:
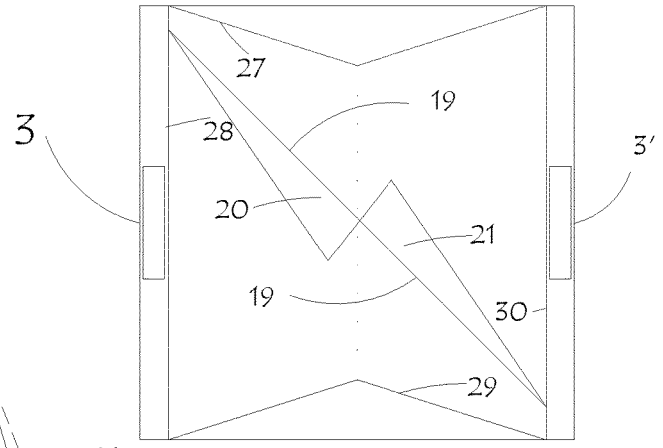
FIG. 11 is a top view of the present invention when incorporated into an assembled rectangular, single panel formed tubular carton, showing the top flanges that adhere to the inside of the gable top 2 of existing cartons and the new additional spout accommodated by the invention.

Referring to FIG. 11, there will be seen a top view of the present invention when incorporated into an assembled rectangular, single panel formed tubular carton 1. In this view the attachment of bottom 16 and side flanges 12 and 14 is omitted for a clearer view of the attachment of top flanges 20 and 21. This view shows Flanges 20 and 21 at top of the carton which when carton is closed and sealed flange 20 is adhered between interior surface of the carton gable 27 and 28, and flange 21 is adhered between interior surface of the carton gable 29 and 30.

Figure 12:
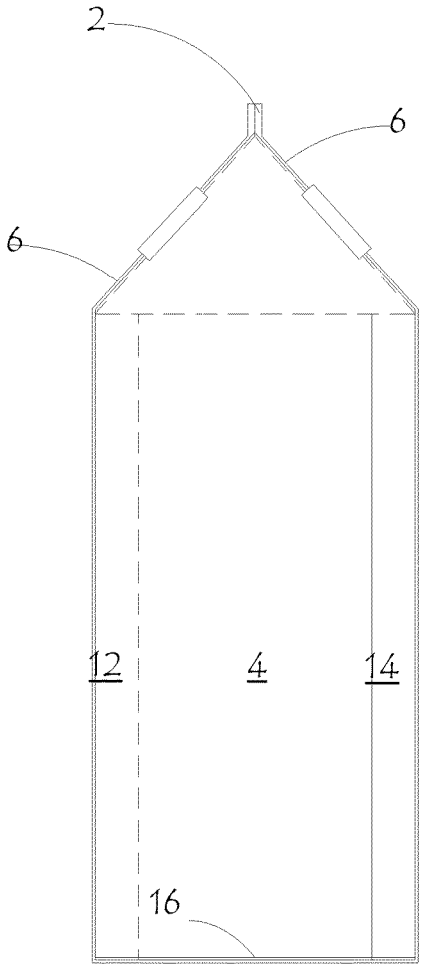
FIG. 12 is a side view of the present invention when incorporated into an assembled rectangular, single panel formed tubular carton and showing the present invention, vertical divider, with flanges on either side that adhere to the existing carton and bottom flange that adheres to the bottom of the carton, and the new additional spout accommodated by the invention.

Referring to FIG. 12, there will be seen a side view of the assembled rectangular, single panel formed tubular carton 1 with the gabled top 2 closed and the divider panel 11 of the present invention installed to accommodate new additional pouring spout 3' for a separate flavor beverage. The divider panel 11 is disposed between the interior surfaces of the adjacent panels 4. The flat surface of side of the carton and 6 denotes gabled top 2 of the carton collapsed, joined and sealed at 2. The outer corner of flange 12 is adhered to the corner of the carton 1 and the opposite side of flange 12 is adhered to the interior surface of the carton 1. Similarly, on the right of the divider, the outer corner of flange 14, is adhered to the corner of the carton, and the opposite side of flange 14, then be adhered to the interior surface of the carton, exactly opposite diagonal the first. The bottom flange 16 is adhered to the bottom of the carton. Flanges 20 and 21 at the top are adhered to collapse panels 6 and 6' on each side of gable top 2 of the carton 1.

Figure 13:
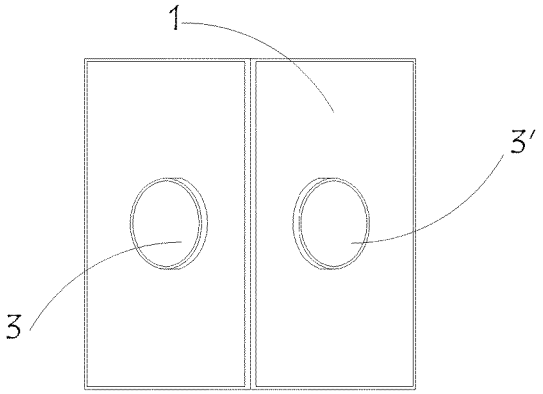
FIG. 13 is a top view of an assembled rectangular, single panel formed tubular carton and showing the new additional spout accommodated by the present invention.

Referring to FIG. 13, there will be seen a top view of a carton showing carton spouts 3 and 3' when the gabled top 2 is closed and sealed after manufacture, identified by the numeral 1, the existing spout for pouring 3, and the new additional spout 3' accommodated by the divider panel 11 of the present invention 3'.

Figure 14:
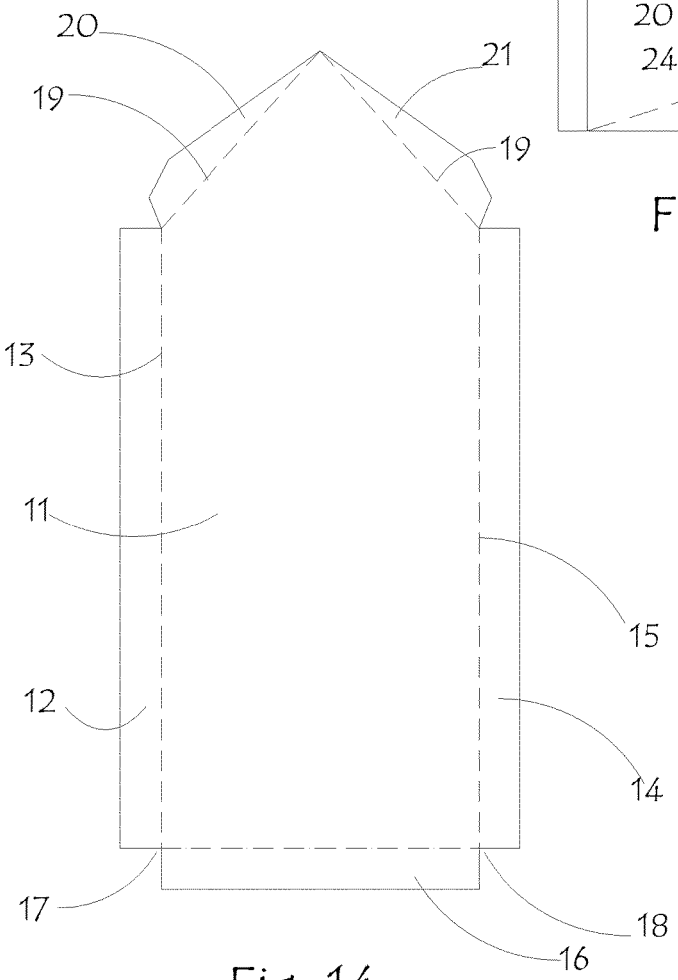
FIG. 14 is a front, 2 dimensional view of another embodiment of the present invention before its incorporation and manufacture into a juice or liquid drink carton.

Referring to FIG. 14, there will be seen a 2 dimensional view of an embodiment of a lateral divider panel 11 of the present invention before its incorporation and manufacture into a juice or liquid drink carton. The flange 12 on the left edge of the divider 11 will be created by folding at the crease line 13 and the opposite side of flange 12 is adhered to an interior surface the adjacent sides 4 of the carton 1 that are perpendicular to the carton side with spout. The edge formed by the fold along line 13 adhered along a line running along the vertical mid-section of the adjacent sides 4. Similarly, the flange 14 on the right of the divider be created by folding along crease line 15 in the opposite direction. Flange 14 will then be adhered to the lateral interior surface of the container opposite the first, with the edge formed by the fold at line 15 adhered along a line running along the exact vertical middle of said opposite lateral side. The bottom flange 16 is scored along the crease line extending from the corners 17 to 18, and then adhered to the bottom of the carton 1.

Flanges 20 and 21 at top of divider are created by folding at lines 19 on both sides, this time extending between the apex of the top triangular portion and an intersection with the vertical crease lines 13 and 15. Top flanges 20 and 21, when installed in carton 1, are adhered to interior surface of gable sides of the carton that are perpendicular to the spout gable sides.

Figure 15:
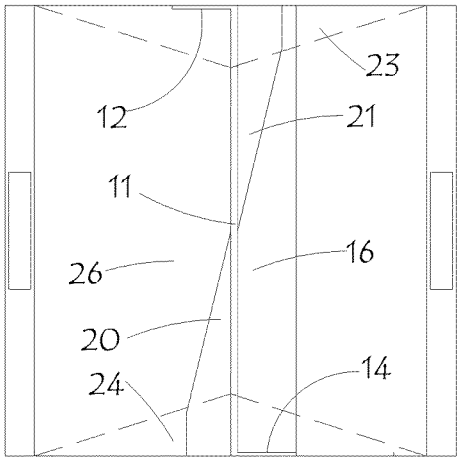
FIG. 15 is a top view of this embodiment of the present invention when incorporated into an assembled rectangular, single panel formed tubular carton, showing the attachment of bottom and side flanges and the new additional spout accommodated by the invention.

Referring to FIG. 15, there will be seen a top view of the present invention when incorporated into an assembled rectangular, single panel formed tubular carton, showing the attachment of bottom 16 and side flanges 12 and 14, the top flanges 20- and 21, gables sides to which top flanges are adhered, and the new additional spout 3 accommodated by the invention. The outer corner of flange 12 is adhered to a line running along the a vertical mid-section of the adjacent lateral sides 4 of the carton 1 that are perpendicular to the carton spout side 6. Similarly, the flange 14, will be adhered to the lateral interior surface of the container opposite the first, with the outer corner of 14 adhered along a line running along a vertical mid-section of the adjacent side opposite. Flange 20 at top of the divider 11, when installed in carton, is adhered to an interior surface of gable side of the carton, 24, when collapsed and positioned roughly parallel to flange 20. Flange 21 at top of divider, when installed in carton, is adhered to interior of gable side of the carton, 23 when collapsed and positioned roughly parallel to flange 21. The bottom flange 16 is adhered to the bottom of the carton 26.

Figure 16:
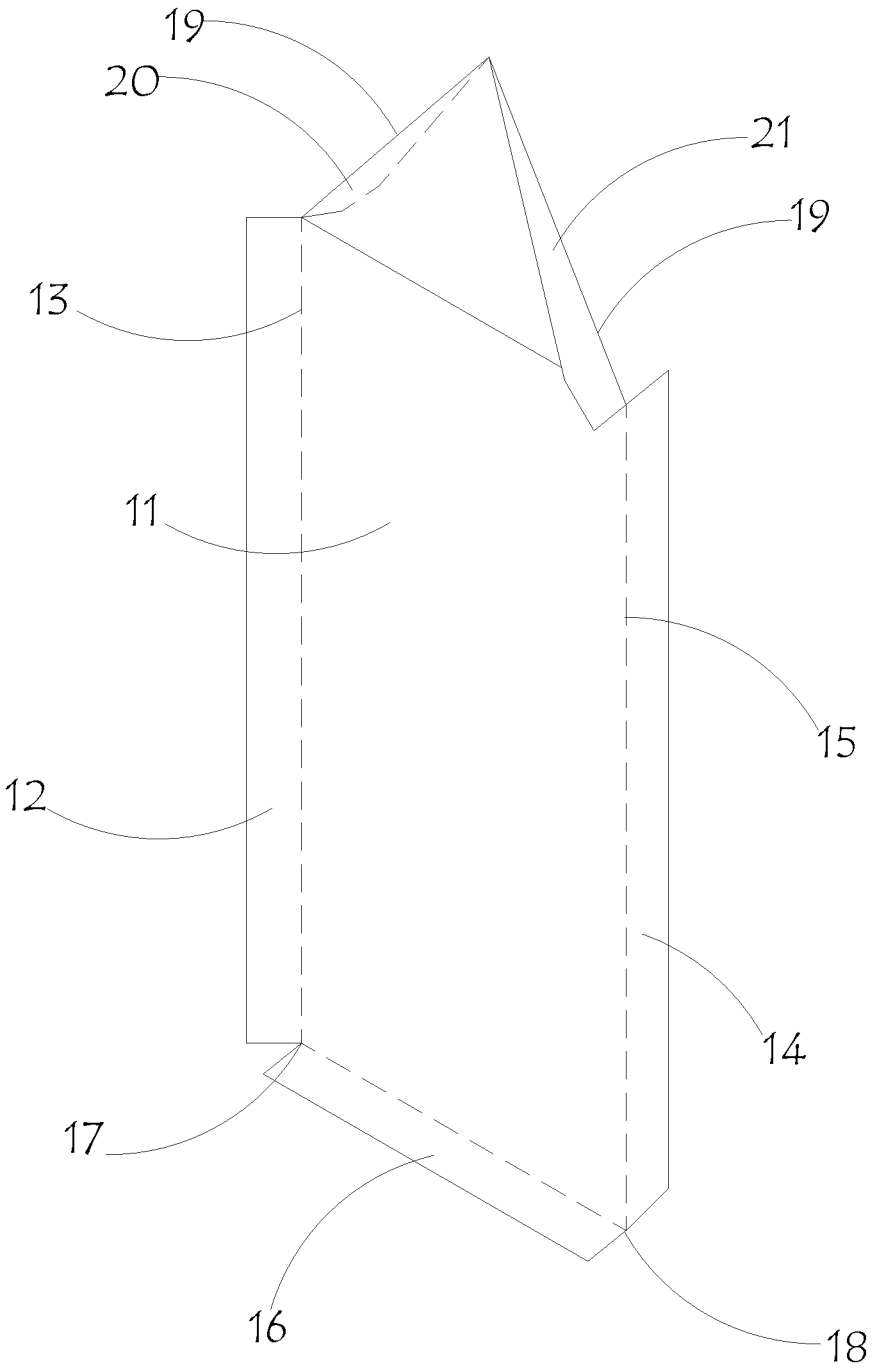
FIG. 16 shows a perspective view of this embodiment of the present invention before its incorporation and manufacture into a juice or liquid drink carton, and showing the creases and direction of the folds that fit into and adhere to the existing cartons.

Referring to FIG. 16, there will be seen a perspective view of the present invention before its incorporation and manufacture into a juice or liquid drink carton, and showing the creases and direction of the folds that fit into and adhere to the existing cartons. 11 shows the vertical invention before any folds or adherence to cartons. The flange, 12, on the left edge of the divider will be created by folding at the scored dashed/dotted line, 13 and the opposite side of flange 12, then be adhered to a lateral interior surface of the carton that is perpendicular to the carton side with spout, with the edge formed by the fold a line 13 adhered along a line running along the exact vertical middle of said lateral side. Similarly, the flange on the right of the divider, 14, will similarly be created by folding at scored dashed/dotted line, 15 in the opposite direction and will then be adhered to the lateral interior surface of the container opposite the first, with the edge formed by the fold at line 15 adhered along a line running along the exact vertical middle of said opposite lateral side. The bottom flange 16 is scored along dashed/dotted line extending from the corners 17 to 18, and then adhered to the bottom of the carton. Flanges 20 and 21 at top of divider are created by folding at line 19 on both sides, and when installed in carton, are adhered to interior of gable sides of the carton that are perpendicular to the spout gable sides.

Figure 17:
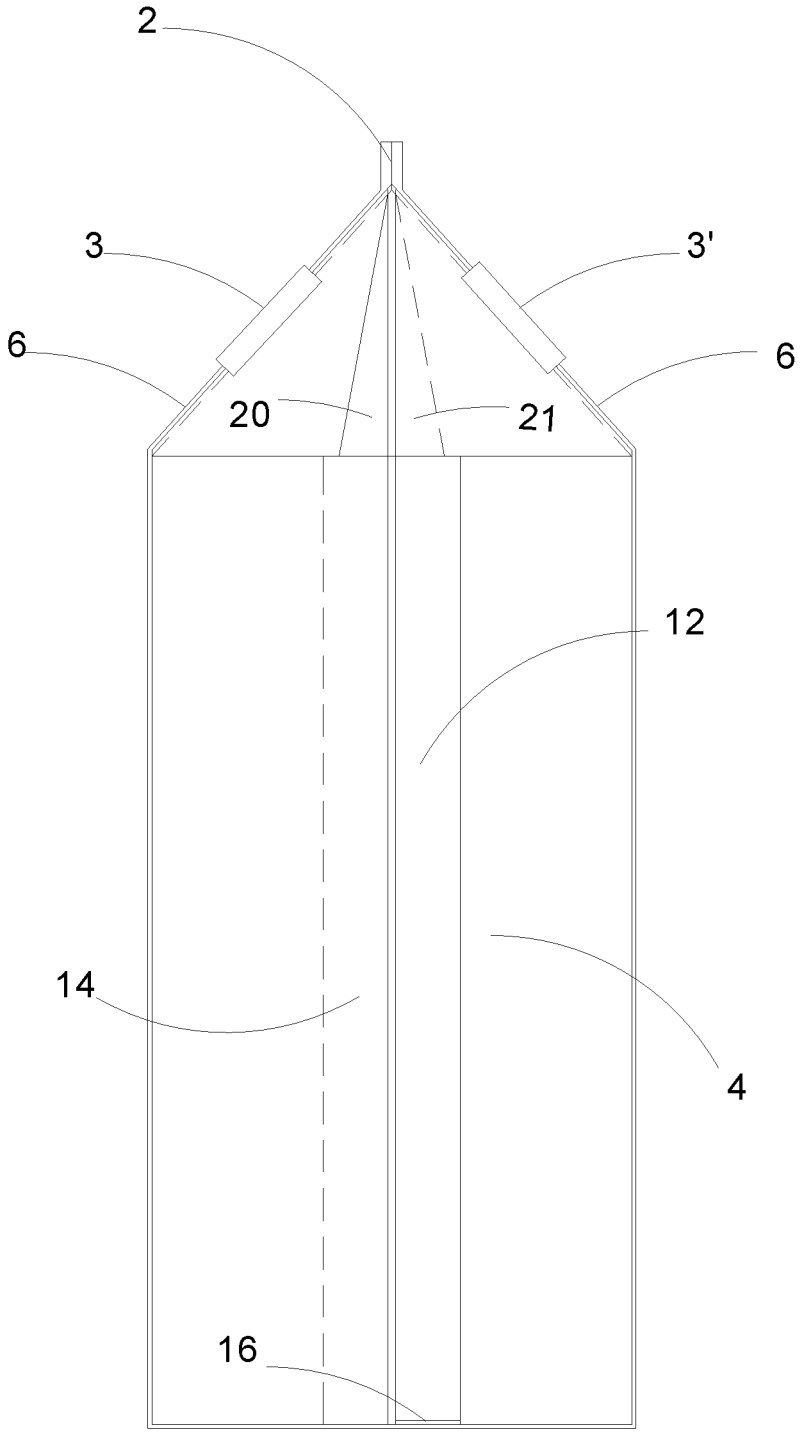
FIG. 17 is a side view of the present invention when incorporated into an assembled rectangular, single panel formed tubular carton and showing the present invention, vertical divider, with flanges on either side that adhere to the existing carton and bottom flange that adheres to the bottom of the carton, and the new additional spout accommodated by the invention.

Referring to FIG. 17, there will be seen a side view of the assembled rectangular, single panel formed tubular carton 1 and with the gabled top 2 closed and sealed and with the divider panel 11 of the present invention installed to accommodate new additional pouring spout 3' for a separate flavor. 4 shows the flat surface of side of the carton and 6 denotes gabled top 2 of the carton collapsed, joined and sealed at 2. The outer corner of flange 12 is adhered to the interior surface of the carton along a line running along the vertical mid-section of the lateral side 4 of the carton and the opposite side of flange 12 is then be adhered to the interior surface of the carton 1. Similarly, the outer corner of flange 14 is adhered to the interior surface of the carton along a line running along the vertical mid-section of the adjacent lateral side 4 of the carton and the opposite side of flange 14 is then adhered to the interior surface of the carton 1 opposite the first. The bottom flange 16 is adhered to the bottom of the carton. Flanges 20 and 21 at top are adhered to collapse panels on each side of gable top 2 of the carton.

Figure 18:
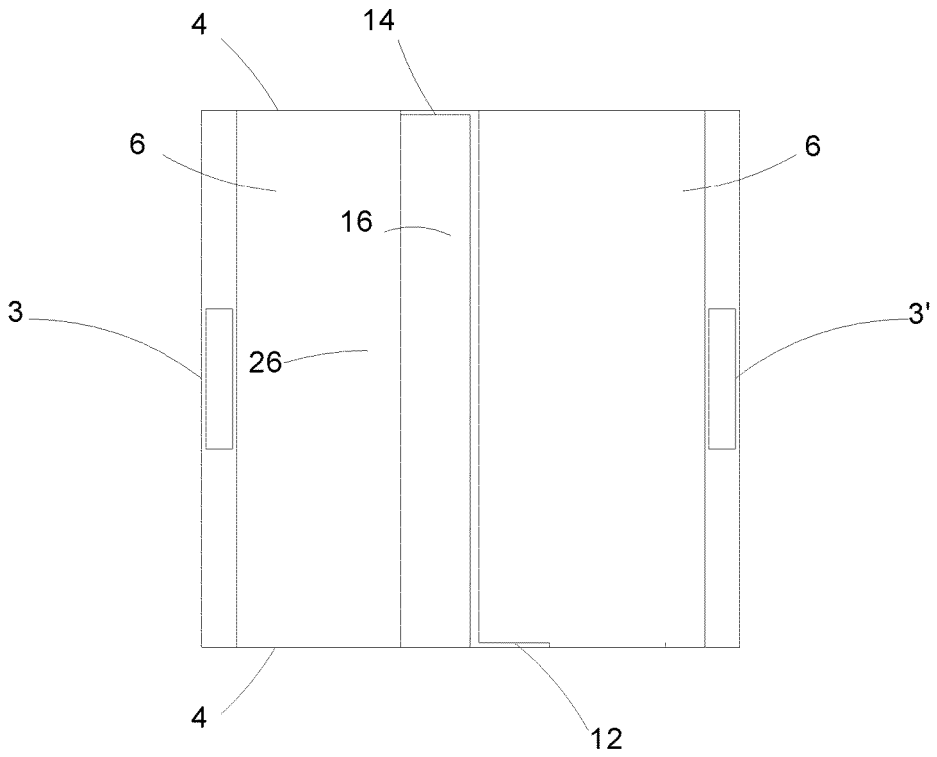
FIG. 18 is a top view of an assembled rectangular, single panel formed tubular carton and showing the new additional spout accommodated by the present invention.

Referring to FIG. 18, the overhead view of the carton illustrates the flange 16 adhered to the bottom surface of the carton, 26. Flanges 12 and 14 are also shown adhered to the interior surfaces of sides 4.

Figure 19:
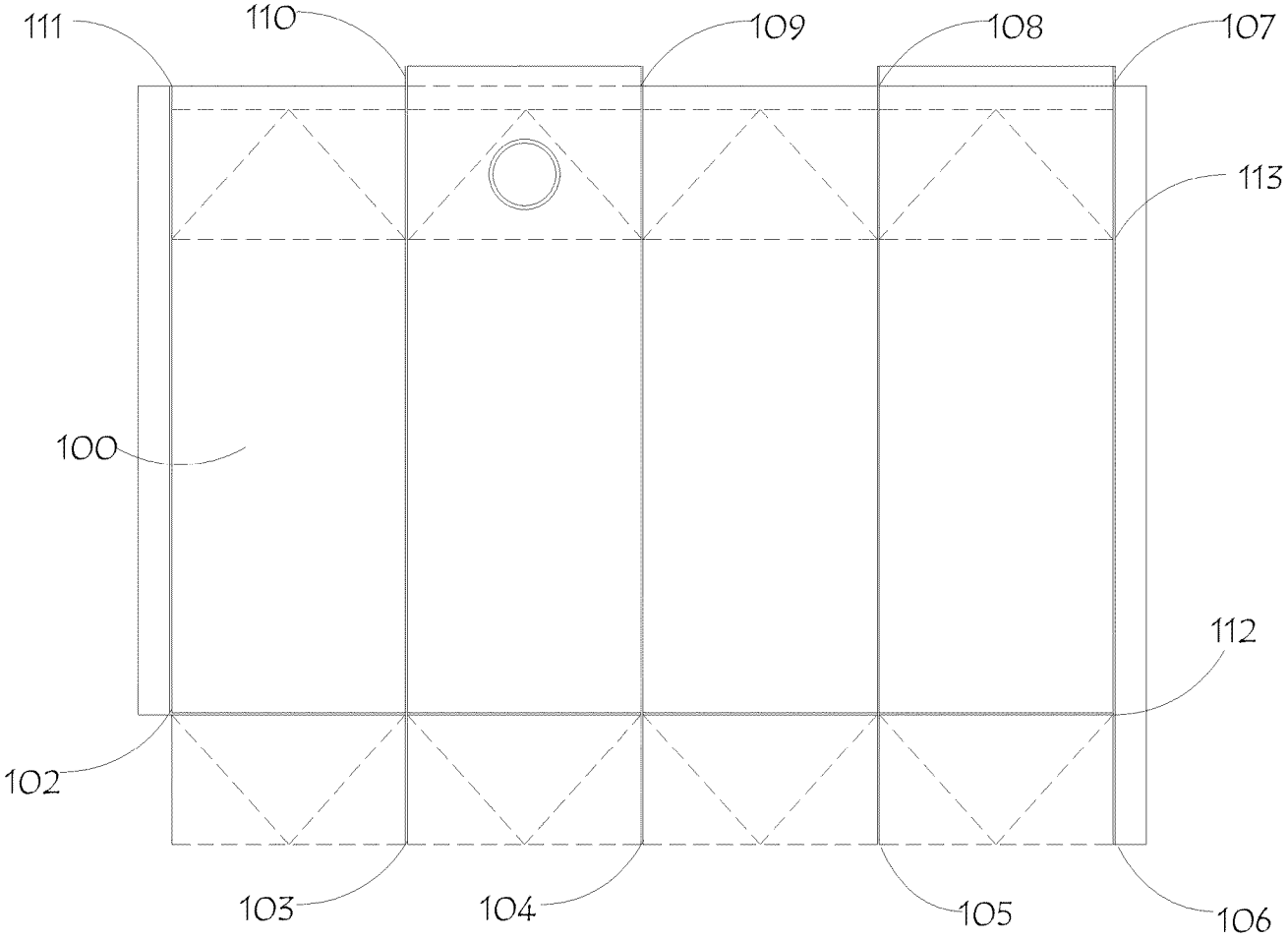
FIG. 19 is a top view of the prior art of an unassembled juice or liquid drink carton.

Referring to FIG. 19 is a 2 dimensional view of a sheet for assembly into cardboard cartons for juice and other liquid drinks. Crease lines 102, 103, 104, 105, 106, 107, 108, 109, 110 and 111 represent lines that when folded at 90 degrees inward to each other to form a rectangular cylinder, with edges for sealing and which when sealed at top and bottom is used to contain juice and other liquid drinks. Folds at lines 102 to 111 and lines 106 to 107 are used to seal the edges of the carton. Line at 112 is folded at 90 to the flat surface of the unassembled carton 101 to form the bottom of the carton. Line at 113 is folded to form a gabled top 2 of the carton 101 when assembled.

Figure 20:
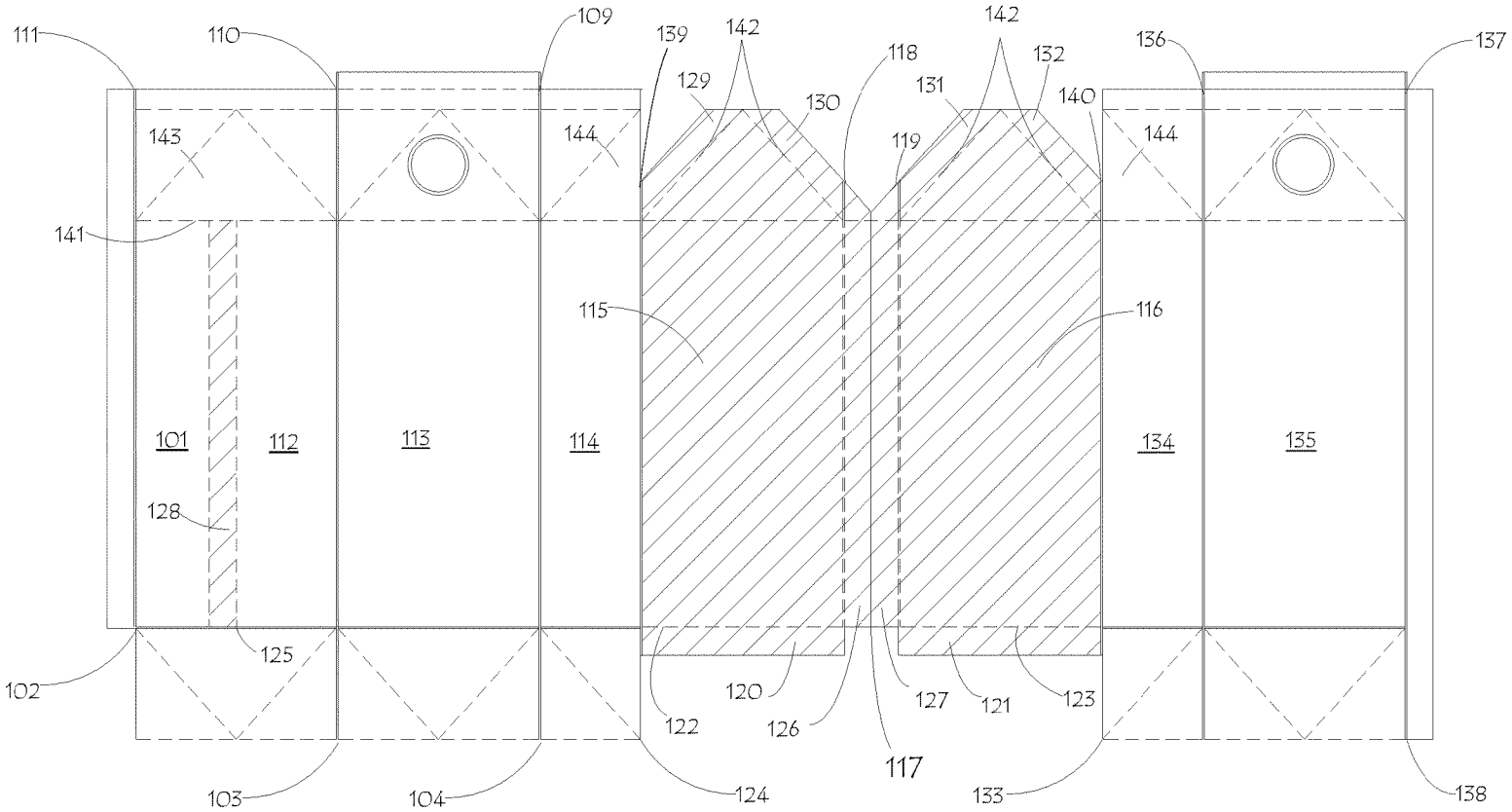
FIG. 20 is a top view of the present invention when incorporated into the prior art of an unassembled juice or liquid drink carton.

Referring to FIG. 20 is a 2 dimensional view of a sheet for assembly into cardboard cartons for juice and other liquid drinks. Lines 102, 103, 104, 105, 106, 107, 108, 109, 110 and 111 represent lines that folded at 90 degrees inward to each other to form a rectangular cylinder, which when sealed at top and bottom is used to contain juice and other liquid drinks. Folds at lines 102 to 111 and lines 106 to 107 are used to seal the edges of the carton. The line at 112 is folded at 90 to the flat surface of the unassembled carton to form the bottom of the carton 101. Line at 113 is folded to form a gabled top 2 of the carton 101 when assembled. When the flat cardboard shape is placed on the reverse side of the side shown, panel 113 is folded upward at 90 degrees to panel 112; panel 114 is folded 90 degrees to panel 113 and is now parallel to 112; panels 115 and 116 a portion of a folding divider of the present invention (shaded) is folded at line 117 until both panels are flat and parallel to each other and then adhered to each other, except for flanges 120 and 121, and flanges 129, 130, 131, and 132; this assembly is then folded at a right angle at lines 118 and 119 which run congruent on either side of the assembly. The assembly thus adhered, if folded at line 124, 90 degrees to panel 114, will form a divider that touches the middle of panel at a line 125.

The flange formed by panel 126 and 127, a portion of the present invention (shaded) is then adhered to shaded area 128. Panel 134 is folded at line 133, again 90 degrees to panel 116 and panel 135 folded at line 136, 90 degrees to panel 134, and folds at line 137 to 138 are used to seal the edges of the carton. Divider is slit from its top edges at 139 and 140 down to line 141 and thus flanges 129, 130, 131 and 132 can be folded at lines 142 and be adhered to gable top 2 panels 143 and 144.

Figure 21:
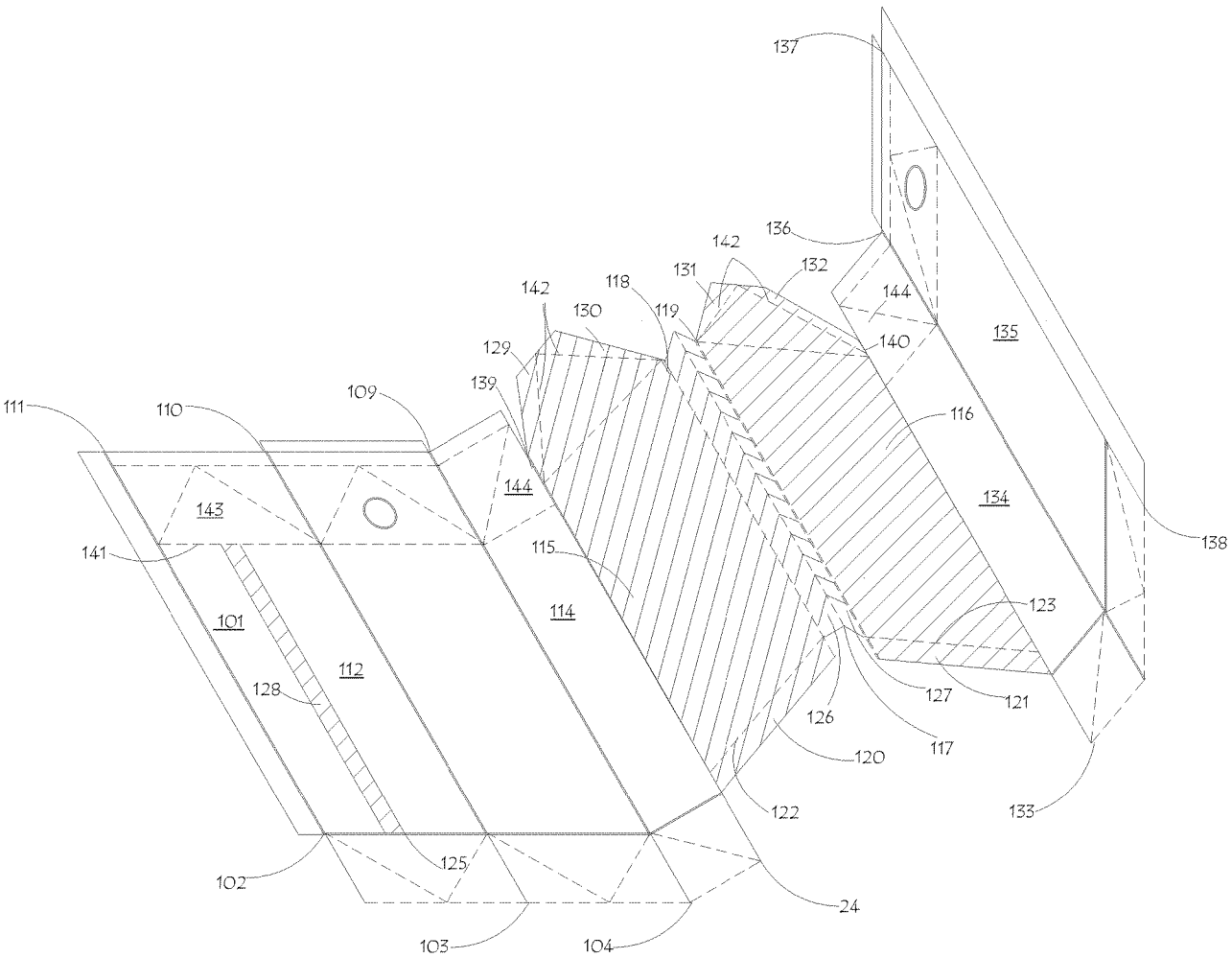
FIG. 21 is a perspective view of the present invention when incorporated into the prior art of a partially assembled juice or liquid drink carton showing the creases and direction of folds that are adhered to form the finished carton.

Referring to FIG. 21 is a 3 dimensional view of to sheet for assembly into cardboard cartons for juice and other liquid drinks. Lines 102, 103, 104, 105, 106, 107, 108, 109, 101 and 111 represent lines that folded at 90 degrees inward to each other to form a rectangular cylinder, which when sealed at top and bottom is used to contain juice and other liquid drinks. Folds at line 102 to 111 and lines 106 to 107 are used to seal the edges of the carton. Line at 112 is folded at 90 to the flat surface of the unassembled carton to form the bottom of the carton. Line at 113 is folded to form a gabled top 2 of the carton when assembled. When the flat cardboard shape is placed on the reverse side of the side shown, panel 113 is folded upward at 90 degrees to panel 112; panel 114 is folded 90 degrees to panel 113 and is now parallel to 112; panels 115 and 116 a portion of the present invention (shaded) is folded at line 117 until both panels are flat and parallel to each other and then adhered to each other, except for flanges 120 and 121, and flanges 129, 130, 131, and 132; this assembly is then folded at a right angle at lines 118 and 119 which run congruent on either side of the assembly; The assembly thus adhered, if folded at line 124, 90 degrees to panel 114, will form a divider that touches the middle of panel at a line 125. The flange formed by panel 126 and 127, a portion of the present invention (shaded) is the adhered to shaded area 128. Panel 134 is folded at line 133, again 90 degrees to panel 116 and panel 135 folded at line 136, 90 degrees to panel 134, and folds at line 137 to 138 are used to seal the edges of the carton. Divider is slit from its top edges at 139 and 140 down to line 141 and thus flanges 129, 130, 131 and 132 can be folded at lines 142 and be adhered to gable top 2 panels 143 and 144.

Figure 22:
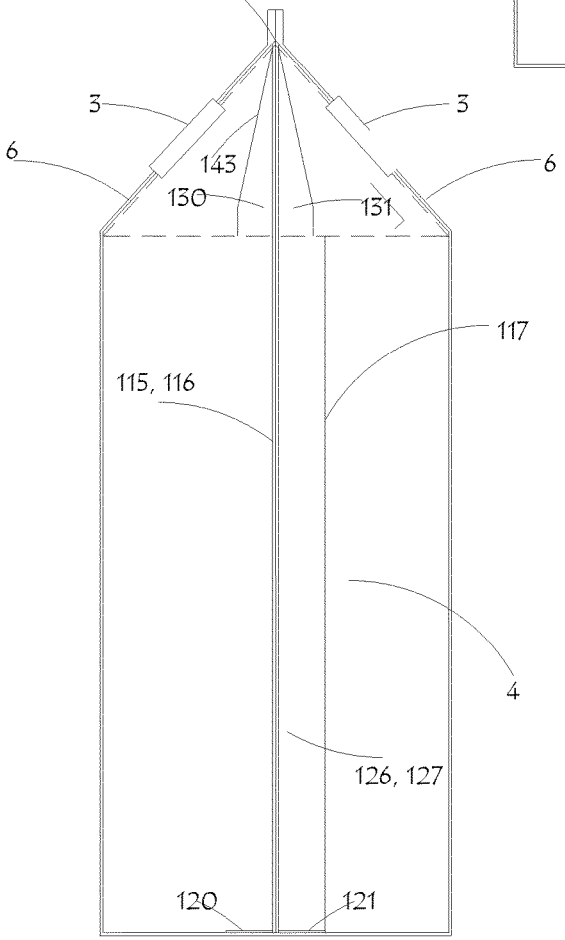
FIG. 22 is a side view of the present invention when incorporated into an assembled rectangular, single panel formed tubular carton and showing the present invention, vertical divider, with flanges adhered to each other folded and adhered to interior of existing carton, and bottom flange that adheres to the bottom of the carton.

Referring to FIG. 22, there will be seen a side view of the assembled rectangular, single panel formed tubular carton and with the gabled top 2 closed and sealed and with the invention installed to accommodate new additional pouring spout 3' for separate flavor. The flat adjacent surfaces 4, adjacent to spout surface sides 6 of the carton denotes gabled top 2 of the carton collapsed, joined and sealed at 2. Lines 115, 116 are the vertical edge of divider folded within the carton where 117 indicates the edge of flanges 126 & 127 when adhered together and then adhered to interior surface of the carton. Flanges 130 and 131 and (129 and 132, not shown) in top of gabled carton top are shown adhered to interior of gable to 143 (and 144 not shown).

Figure 23:
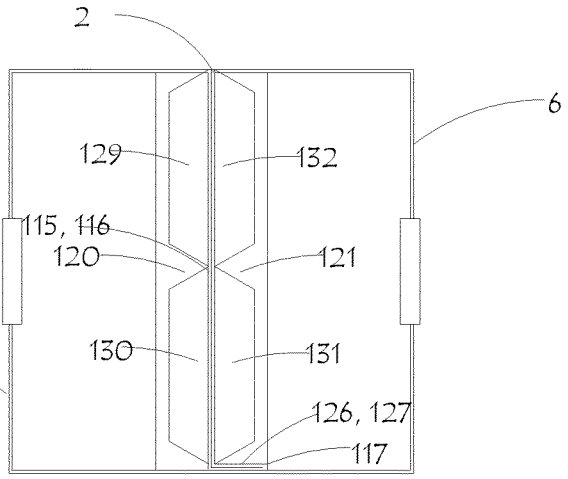
FIG. 23 is a top view of the present invention when incorporated into an assembled rectangular, single panel formed tubular carton and showing the present invention, with flanges adhered to each other folder and adhered to interior of existing carton, and bottom flange that adheres to the bottom of the carton.

Referring to FIG. 23, there will be seen a top view of the present invention when incorporated into an assembled rectangular, single panel formed tubular carton, showing the attachment of bottom and side flanges, the top flanges, gables sides to which top flanges are adhered and the new additional spout accommodated by the invention. Lines 115, 116 are the top edge of divider within carton where 117 indicates the edge of flanges 126-127.

It should be understood, of course, that the foregoing relates to exemplary embodiments of the invention and that modifications may be made without departing from the spirit and scope of the invention as set forth in the following claims.

What is claimed is:

1. A carton for separately containing and independently dispensing two liquids, comprising:

a substantially rectangular tubular carton having at least one sidewall and a bottom wall defining a cavity therein;

an opening at a top end of the carton;

a plurality of folds formed in the at least one sidewall configured, when folded, to produce a gabled closure at the opening; the gabled closure having a pair of inwardly inclined surface walls joined along a sealed ridge;

a divider panel having a plurality of flanges, wherein the flanges are sealingly attached to an interior surface of the at least one sidewall, the bottom wall, and the gabled closure, the divider panel separating the cavity into a first cavity and a second cavity; and a first spout formed in a first inwardly inclined surface wall and a second spout formed in an opposite inwardly inclined surface wall, wherein the first spout is in fluid communication with the first cavity and the second spout is in fluid communication with the second cavity.

2. The carton of claim 1, wherein the divider panel extends between a first interior corner of the cavity and an opposite interior corner of the cavity.

3. The carton of claim 2, wherein the first interior sidewall surface is opposite the second interior sidewall surface.

4. The carton of claim 2, wherein the divider panel has substantially rectangular lower end portion and a substantially triangular upper end portion, wherein the plurality of flanges comprises: a first flange formed along a left and a right vertical edge of the lower end portion, a second flange formed along a bottom edge of the lower end portion, and a third flange formed along a first and a second inwardly inclined edge of the upper end portion.

5. The carton of claim 4, wherein the first flange extends from an opposite face of the divider panel.

6. The carton of claim 4, wherein the third flange extends from an opposite face of the divider panel.

7. The carton of claim 4, wherein the plurality of flanges of the divider panel are sealingly attached to the interior sidewalls with an adhesive.

8. The carton of claim 1, wherein the divider panel extends between a first interior sidewall surface and a second interior sidewall surface.

9. The carton of claim 8, wherein the first interior sidewall surface is adjacent to the second interior sidewall surface.

10. A carton, comprising:

a tubular carton having at least one sidewall and a bottom closure defining a cavity therein;

an opening at a top end of the carton;

a gabled closure at the top end to seal the opening; the gabled closure having a pair of inwardly inclined surface walls joined along a sealed ridge;

a divider panel sealingly separating the cavity into a first cavity and a second cavity; and a first spout extending through the at least one sidewall in fluid communication with the first cavity and a second spout extending through the at least one sidewall in fluid communication with the second cavity.

11. The carton of claim 10, wherein the divider panel has a plurality of flanges defined along a peripheral edge thereof, wherein the plurality of flanges are sealingly attached to an interior surface of the at least one sidewall, the bottom wall, and the gabled closure.

12. The carton of claim 10, further comprising:

a plurality of folds formed in an upper portion of the at least one sidewall configured, when folded, to produce a gabled closure at the opening; the gabled closure having a pair of inwardly inclined surface walls joined along a sealed ridge; wherein a first spout opening is formed in a first inwardly inclined surface wall and a second spout opening formed in an opposite inwardly inclined surface wall, wherein the first spout opening is in fluid communication with the first cavity and the second spout opening is in fluid communication with the second cavity.

13. A material configured to form a folded beverage container, comprising:

a substantially rectangular sheet of foldable material having a plurality of vertical fold lines extending between a top edge of the sheet and a bottom edge of the sheet, the fold lines defining a plurality of sidewall panels;

a lower horizontal fold line extending across a width of the sheet defining a lower closure portion, a pair of lower diagonal fold lines originating at an intersection of the plurality of vertical fold lines and the lower horizontal fold line and terminating at an intersection point that is midway between the plurality of vertical fold lines and proximal to a lower edge of the sheet;

a first upper horizontal fold line extending across a width of the sheet defining a gabled closure portion, a second upper horizontal fold line extending across an edge portion of the sheet defining a gabled closure sealing portion;

the gabled closure portion having a plurality of upper diagonal fold lines originating at an intersection of the plurality of vertical fold lines and the upper horizontal fold line and terminating at an apex along the second upper horizontal fold line;

a plurality of vertical divider panel folds formed in one of the plurality of sidewall panels defining a divider panel, and a plurality of divider flange fold lines formed in the divider panel defining a top flange, a bottom flange, and a vertical edge flange configured for sealing engagement with the interior sidewalls of the carton when the sheet is folded.

* * * * *